United States Patent [19]

Caravajal et al.

[11] Patent Number: 4,908,148

[45] Date of Patent: Mar. 13, 1990

[54] RINSE ADDITIVE COMPOSITIONS PROVIDING GLASSWARE PROTECTION COMPRISING INSOLUBLE ZINC COMPOUNDS

[75] Inventors: Gregory S. Caravajal; Gretchen R. Hatfield, both of Fairfield, Ohio

[73] Assignee: The Procter & Gamble Company, Cincinnati, Ohio

[21] Appl. No.: 310,813

[22] Filed: Feb. 13, 1989

[51] Int. Cl.[4] ..... C11D 3/12; C11D 7/20

[52] U.S. Cl. ..... 252/135; 252/89.1; 252/90; 252/170; 252/171; 252/174; 252/174.21; 252/174.22; 252/174.24; 252/548; 252/558; 252/DIG. 14; 252/DIG. 16

[58] Field of Search ..... 252/89.1, 170, 171, 252/174, 90, 544, 174.21, 174.22, DIG. 14, 548, 558, DIG. 16, 174.24, 135

[56] References Cited

U.S. PATENT DOCUMENTS

| | | | |
|---|---|---|---|
| 2,241,984 | 5/1941 | Cooper | 252/156 |
| 2,447,297 | 8/1948 | Wegst et al. | 252/135 |
| 2,514,304 | 7/1950 | Bacon et al. | 134/29 |
| 2,575,576 | 11/1951 | Bacon et al. | 252/138 |
| 2,892,797 | 6/1959 | Alexander et al. | 252/313 |
| 3,128,250 | 4/1964 | Lintner | 252/99 |
| 3,255,117 | 6/1966 | Knapp et al. | 252/99 |
| 3,350,318 | 10/1967 | Green | 252/135 |
| 3,410,804 | 11/1968 | Walsh | 252/99 |
| 3,640,878 | 2/1972 | Chirash et al. | 252/99 |
| 3,677,820 | 7/1972 | Rutkowski | 134/25 |
| 3,696,041 | 10/1972 | Gray | 252/99 |
| 3,701,736 | 10/1972 | Austin et al. | 252/99 |
| 3,755,180 | 8/1973 | Austin | 252/99 |
| 3,826,748 | 7/1974 | Finck | 252/99 |
| 3,852,209 | 12/1974 | Hofmann | 252/95 |
| 3,966,627 | 6/1976 | Gray | 252/99 |
| 4,416,794 | 11/1983 | Barrat et al. | 252/174.15 |
| 4,443,270 | 4/1984 | Biard et al. | 134/25.2 |

FOREIGN PATENT DOCUMENTS

| | | |
|---|---|---|
| 62875 | 4/1971 | Australia . |
| 951211 | 7/1974 | Canada . |
| 1042753 | 11/1978 | Canada . |
| 295093 | 12/1988 | European Pat. Off. . |
| 2539531 | 3/1977 | Fed. Rep. of Germany . |
| 63-045115 | 2/1988 | Japan . |
| 1285845 | 8/1972 | United Kingdom . |
| 1328073 | 8/1973 | United Kingdom . |
| 1333810 | 10/1973 | United Kingdom . |
| 1517029 | 7/1978 | United Kingdom . |
| 1586067 | 3/1981 | United Kingdom . |
| 2196972 | 5/1988 | United Kingdom . |

OTHER PUBLICATIONS

BF Goodrich Trade Publication GC-67 entitled, "Carbopol Water Soluble Resins".

*Primary Examiner*—Prince E. Willis
*Attorney, Agent, or Firm*—Gretchen R. Hatfield; Donald E. Hasse; Thomas H. O'Flaherty

[57] ABSTRACT

Disclosed are rinse additive compositions containing an insoluble inorganic zinc salt useful for inhibition of glassware corrosion caused by automatic dishwashing detergents in the dishwasher. These compositions are particularly desirable because use of them in the dishwasher does not result in precipitation of zinc insolubles on the dishware or dishwasher parts.

15 Claims, No Drawings

RINSE ADDITIVE COMPOSITIONS PROVIDING GLASSWARE PROTECTION COMPRISING INSOLUBLE ZINC COMPOUNDS

TECHNICAL FIELD AND BACKGROUND ART

This invention relates to rinse additive compositions containing insoluble inorganic zinc salts which are useful for inhibiting glassware corrosion which can occur in an automatic dishwasher.

Corrosion of glass in automatic dishwashers is a well known phenomenon. A paper by D. Joubert and H. Van Daele entitled "Etching of Glassware in Mechanical Dishwashing" in Soap and Chemical Specialties, Mar. 1971, pp. 62, 64, and 67, discusses the influence of various detergent components, particularly those of an alkaline nature. This subject is also discussed in a paper entitled "The Present Position of Investigations Into the Behavior of Glass During Mechanical Dishwashing" presented by Th. Altenschoepfer in April, 1971, at a symposium in Charleroi, Belgium, on "The Effect of Detergents on Glassware in Domestic Dishwashers". See also another paper delivered at the same symposium by P. Mayaux entitled "Mechanism of Glass Attack by Chemical Agents".

It has been determined that the glassware corrosion problem actually consists of two separate phenomena; one is corrosion due to the leaching out of minerals from the glass composition itself together with hydrolysis of the silicate network, and the second is deposition and redeposition of silicate material onto the glass. It is a combination of the two that can result in the cloudy appearance of glassware that has been washed repeatedly in an automatic dishwasher. This cloudiness often manifests itself in the early stages as an iridescent film that becomes progressively more opaque with repeated washings. The harsh washing conditions of the automatic dishwashing process, particularly the use of detergency builders and the high alkalinity, are believed to cause glassware corrosion.

Use of zinc, in general, in automatic dishwashing detergent compositions to prevent glass corrosion is known, See for example, U.S. Pat. No. 3,677,820, Rutkowski, issued July 18, 1972, which discloses hanging a strip of metallic zinc in the dishwasher to prevent corrosion of glassware. U.S. Pat. No. 3,255,117, Knapp et al, issued June 7, 1966, discloses the use of soluble zinc salts in automatic dishwashing detergent compositions to prevent glassware corrosion. This reference states that introducing soluble metal salts (alkali aluminate, zincate, or berylliate) in automatic dishwashing detergent compositions can result in precipitation out of insoluble material. Such material is said to be very undesirable as it can adhere to dishwasher parts and dishware during the washing cycle. This precipitation is said to be avoided by carefully adjusting the levels and proportions of the various components in product formulation.

U.S. Pat. No. 3,350,318, Green, issued Oct. 31, 1967, also describes the use of soluble zinc salts (sodium aluminate, sodium zincate) to prevent attack by automatic dishwashing detergent compositions of overglaze colors and decorations on fine china and the aluminum of pots and pans. The problem of precipitate formation is discussed and said to be avoided by spraying a solution of the soluble zinc salt onto granular polyphosphate particles.

U.S. Pat. No. 2,575,576, Bacon et al, issued Nov. 20, 1951, describes the use of a water-soluble zinc or aluminum salt to prevent the corrosion of vitreous and ceramic surfaces. It is stated that the problem of compounding alkali metal salts such as sodium carbonates, -phosphates, -silicates, or -sulfates with water-soluble zinc or aluminum compounds is that an undesirable precipitate is formed. This problem is said to be overcome by the careful choice of particular components at particular ranges and proportions.

U.S. Pat. No. 3,755,180, Austin, issued Aug. 28, 1973, describes use of a precipitated silico-aluminate compound for inhibiting overglaze attack in china. Again, the problem of precipitate formation when soluble zinc and aluminum salts are utilized for this purpose is discussed. (See also U.S. Pat. No. 3,966,627, Gray, issued June 29, 1976.)

U.S. Pat. No. 4,443,270, Baird et al, issued Apr. 17, 1984, discloses a rinse additive formulation containing a low-foaming nonionic surfactant, a chelating agent, a hydrotrope-water solubilizing system, and a soluble magnesium, zinc, or bismuth salt. The metal salt is said to be present for protection against glassware corrosion caused in the rinse. See also U.S. Pat. No. 4,416,794, to Barrat et al, issued Nov. 22, 1983. More specifically, the water-soluble zinc salts of chloride, sulfate, or acetate are taught.

Despite these disclosures, there is a continuing need for methods of providing protection against glassware corrosion in the dishwasher without causing the formation of insolubles.

Accordingly, it is an object of the present invention to provide compositions which protect glassware against corrosion in the dishwasher without causing the formation of insolubles which can adhere to dishwasher parts and dishware.

It has been surprisingly discovered that by utilizing certain insoluble inorganic zinc salts in rinse additive compositions, the above objectives can be attained.

SUMMARY OF THE INVENTION

The present invention relates to liquid rinse additive compositions, for use in an automatic dishwashing machine to inhibit glassware corrosion caused by washing with an automatic dishwashing detergent composition, comprising:

(a) from 0% to about 70% of a low-foaming polyoxyalkylene nonionic surfactant;

(b) an amount of an insoluble inorganic zinc salt, having an average particle size of less than 250 microns, that will provide the composition with a level of zinc of from about 0.01% to about 10.0%, preferably from about 0.1% to about 5.0%; and (c) from about 25% to about 90% of a solvent system.

The present invention also relates to solid rinse additive compositions, for use in an automatic dishwashing machine to inhibit glassware corrosion caused by washing with an automatic dishwashing detergent composition, comprising:

(a) from 0% to about 70% of a low-foaming polyoxyalkylene nonionic surfactant;

(b) an amount of an insoluble inorganic zinc salt, having an average particle size of less than 250 microns, that will provide the composition with a level of zinc of from about 1.0% to about 70%, preferably from about 2.0% to about 15%; and (c) from about 30% to about 98% of a binder.

The present invention also relates to a method of inhibiting glassware corrosion caused by washing with an automatic dishwashing detergent composition, comprising adding to the rinse water an amount of an insoluble inorganic zinc salt which provides between 0.5 and 10 ppm solubilized zinc to the rinse water.

DETAILED DESCRIPTION OF THE INVENTION

Insoluble Zinc Salt

The present invention provides a means for protecting glassware from corrosion in an automatic dishwashing process without the retention of insoluble material on dishware or dishwasher parts. The present invention provides glassware protection by utilizing an insoluble inorganic zinc salt in liquid and solid rinse additive compositions. Without wishing to be bound by theory, it is believed that zinc present in the dishwashing process deposits onto the surface of the glass, thus inhibiting mineral leaching and silicate hydrolysis which would result in corrosion. It is also believed that the zinc inhibits the deposition of silicate onto glassware during the dishwashing process, resulting in glassware which remains clear in appearance for a longer period of time than glassware which has not been treated with zinc. This treatment does not completely prevent the corrosion of glassware in the automatic dishwasher. It protects glassware against corrosion and allows glassware to remain essentially uncorroded for a longer period of time (for example, the onset of discoloration of the glass may be delayed for about twice as long as is seen with untreated glass). Thus, treatment with zinc slows down the corrosion process.

Because the zinc is in a form in product which is essentially insoluble, the amount of precipitate which will form in the dishwashing process is greatly reduced. The insoluble inorganic zinc salt will dissolve only to a limited extent, hence chemical reaction of dissolved species in the dishwashing process is controlled. Thus, use of zinc in this form allows for control of the release of reactive zinc species and precipitation of insolubles of a large and uncontrolled size in the dishwasher.

It has surprisingly been discovered that zinc in this insoluble form provides glassware corrosion inhibition equivalent to that provided by soluble zinc salts.

It has now been found that glassware treated with the zinc salts of the present invention remains protected after the washing process. Hence, delivery of the zinc to the glass surface in even the final rinse of the dishwashing process will provide protection against corrosion of the glass in subsequent washes.

Delivery of the insoluble inorganic zinc salts of the present invention to glass in the rinse cycle has been found to be much more efficient than delivery in the wash cycle. This is probably due to the fact that the concentration of interfering components is much lower in the rinse cycle than in the wash cycle. Thus, less zinc may be used to deliver the glassware protection than would be required if the zinc were added in the wash cycle.

By insoluble inorganic zinc salt is meant an inorganic zinc salt which has a solubility in water of less than 1 gram of zinc salt in 100 mls of water.

Examples of zinc salts which meet this criterion, and hence are covered by the present invention, are zinc silicate, zinc carbonate, zinc oxide, zinc basic carbonate (approximately $Zn_2(OH)_2CO_3$), zinc hydroxide, zinc oxalate, zinc monophosphate ($Zn_3(PO_4)_2$), and zinc pyrophosphate ($Zn_2(P_2O_7)$).

The level of insoluble zinc salt necessary to achieve the glassware protection benefit of the present invention, is an amount that provides the rinse additive composition with a total level of zinc between about 0.01% and about 70%. An amount less than 0.01% zinc is insufficient to provide the desired protection against glassware corrosion. The exact level of zinc salt to be used will depend somewhat on the particular insoluble inorganic zinc salt chosen for use in the composition. The more insoluble the salt, the greater amount necessary to achieve the same level of benefit. This is because less zinc will solubilize in the dishwasher and become available for treatment of the glassware.

Since most of the insoluble zinc material will remain in essentially the same form throughout the dishwashing process, it is important that the particle size of the insoluble inorganic zinc salt be small enough so that the material will pass through the dishwashing process without adhering to dishware or dishwasher parts. If the average particle size of the insoluble zinc salt is kept below 250 microns, insolubles in the dishwasher should not be a problem. Preferably, the insoluble inorganic zinc salt material has an average particle size even smaller than this to insure against insolubles on dishware in the dishwasher, e.g., a size smaller than 100 microns. This is especially true when high levels of insoluble inorganic zinc salts are utilized. Furthermore, the smaller the particle size, the more efficient the insoluble inorganic zinc salt in protecting glassware. If a very low level of insoluble inorganic zinc salt is utilized it is most desirable to use material having a very small particle size, e.g. smaller than about 100 microns. For the very insoluble inorganic zinc salts a smaller particle size may be necessary to get the desired efficacy for glassware protection. For example, with zinc oxide a desired particle size might be less than about 100 microns Finally, in the present invention, a small particle may be necessary to keep the insoluble inorganic zinc salt homogeneously dispersed in the liquid composition.

Ethoxylated Nonionic Surfactant

Though nonionic surfactants are not required in the present compositions, they are advantageously employed to promote wetting, enhance sheeting action, and increase the rate of water drainage, thereby reducing water spotting on the washed tableware. Nonionic surfactants useful in the present invention include, but are not limited to, the following polyoxyalkylene nonionic detergents: $C_8$–$C_{22}$ normal fatty alcohol-ethylene oxide condensates, i.e., condensation products of 1 mole of a fatty alcohol containing from about 8 to about 22 carbon atoms with from about 2 to about 20 moles of ethylene oxide; polyoxypropylene-polyoxyethylene condensates having the formula $$HO(C_2H_4O)_x(C_3H_6O)_y(C_2H_4O)_{xl}H$$

wherein y equals at least about 15 and $(C_2H_4O)_{x+xl}$ equals from about 20% to about 90% of the total weight of the compound; alkyl polyoxypropylene polyoxyethylene condensates having the formula $RO\text{-}(C_3H_6O)_x(C_2H_4O)_yH$ where R is an alkyl group having from 1 to about 15 carbon atoms and x and y each represent an integer from about 2 to about 98; polyoxyalkylene glycols having a plurality of alternating hydrophobic and hydrophilic polyoxyalkylene chains, the hydrophilic chains consisting of linked oxyethylene radicals and the hydrophobic chains consisting of linked oxypropylene radicals, said product having three hydrophobic chains, lined by two hydrophilic chains, the central hydrophobic chain constituting from about 30% to about 34% by weight of the product, the linking hydrophilic chains together constituting from about 31% to about 35% by weight of the product, the intrinsic viscosity of the product being from about 0.06 to about 0.09 and the molecular weight being from about 3,000 to about 5,000 (all as described in U.S. Pat. No. 3,048,548); butylene oxide capped alcohol ethoxylates having the formula:

$$R(OC_2H_4)_y(OC_4H_8)_xOH$$

where R is an alkyl group containing from about 8 to about 18 carbon atoms and y is from about 3.5 to about 10 and x is from about 0.5 to about 1.5; benzyl ethers of polyoxyethylene condensates of alkyl phenols having the formula:

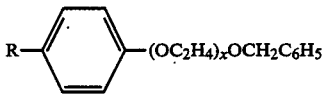

where R is an alkyl group containing from about 6 to about 20 carbon atoms and x is an integer from about 5 to about 40; and alkyl phenoxy polyoxyethylene ethanols having the formula:

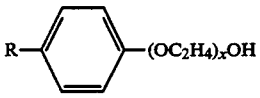

where R is an alkyl group containing from about 8 to about 20 carbon atoms and x is an integer from about 3 to about 20. Other nonionic detergents are suitable for use in the herein disclosed rinse additive compositions, and it is not intended to exclude any detergent possessing the desired attributes.

Preferred nonionic surfactants are the condensates of from about 2 to about 15 moles of ethylene oxide with 1 mole of a $C_8$–$C_{20}$ aliphatic alcohol. Particularly preferred surfactants are those based on ethylene oxide condensates with primarily aliphatic alcohols made by the "oxo" process. These alcohols are predominantly straight-chain aliphatic alcohols, with up to about 25% of short-chain branching at the 2-position. A suitable range of alcohol ethoxylates is made by the Shell Chemical Company and is sold under the trade name "Dobanol". A particularly preferred material of this type is Dobanol 45-4, which is the reaction product of 4 moles of ethylene oxide with 1 mole of a $C_{14}$–$C_{15}$ oxo-alcohol Another preferred commercially available range of surfactants is based on the ethoxylates of relatively highly branched alcohols, containing up to 60% of $C_1$–$C_6$ branching at the 2-position. These alcohols are sold under the trade name "Lial" by Liquichimica Italiana. A preferred material is Lial 125–4, the condensation product of 4 moles of ethylene oxide with a $C_{12}$–$C_{15}$ alcohol.

Further examples of suitable nonionic surfactants can be found in British Patent No. 1,477,029.

The level of polyoxyalkylene nonionic surfactant can be from 0% to about 70% by weight, preferably from about 10% to about 60% by weight of the rinse additive.

Chelating Agent

A chelating agent may be present in the rinse additive compositions of the present invention. The chelating agent can be any of a wide range of organic or inorganic sequestering agents, examples including phosphoric acid, amino polycarboxylic acids such as EDTA, NTA, and DETPA and polycarboxylic acids such as lactic acid, citric acid, tartaric acid, gluconic acid, glucoheptonic acid, mucic acid, galactonic acid, saccharic acid, fumaric acid, succinic acid, glutaric acid, adipic acid, and their alkali metal or ammonium salts. Citric or tartaric acid are preferred chelating acids. The chelating agent, if included, is present in an amount of up to about 30% and normally lies in the range from about 5% to about 20% by weight. Highly preferred compositions use from about 5% to about 10% by weight of chelating agent in order to minimize any attack by the chelating agent on the glass.

Examples of liquid rinse additive compositions comprising chelating agents are described in U.S. Pat. No. 4,443,270, Baird et al, issued Apr. 17, 1984.

The rinse additive compositions of the present invention may be in the form of liquid, solid, or powder rinse additives. Most typically rinse additives are formulated as liquid and solid compositions.

Liquid Rinse Additives

The liquid rinse additive compositions of the present invention comprise a solvent system; an amount of the insoluble inorganic zinc salt, having an average particle size less than about 250 microns, to provide the composition with from about 0.01% to about 10.0%, preferably from about 0.1% to about 5.0% zinc; and optionally, up to about 70% of a low-foaming polyoxyalkylene nonionic surfactant.

An amount of insoluble inorganic zinc salt which will provide less than 0.01% zinc to the composition will not produce sufficient glassware protection in the present invention. An amount of insoluble inorganic zinc salt which will provide more than 10.0% zinc to the composition may result in undesirable insoluble formation in the dishwasher. Furthermore, an amount of insoluble inorganic zinc salt greater than this would be difficult to keep dispersed in the liquid composition. In fact, for levels of insoluble inorganic zinc salt at the higher end of this range it may be necessary to use an average particle size of the salt of less than about 100 microns in order to keep the solid particles dispersed in the liquid composition. Alternatively or concomitantly, it may be desirable to include a dispersant for the insoluble inorganic zinc salt, especially if the composition will be stored for long periods of time. Examples of such a dispersant are polyacrylate and polyethylene glycol. Generally, from about 1.0% to about 10.0% of dispersant will be sufficient to keep the insoluble inorganic zinc salt as a stable dispersion in the present liquid rinse additive compositions. The solvent system is generally water, optionally together with from about 1% to about 25%, preferably from about 2% to about by weight of the composition, of a hydrotrope which may be ethanol, isopropanol, 1,2 propanediol, a lower alkylbenzene sulphonate such as toluene, xylene, or cumene sulphonate, or a mixture of any of these. The solvent system comprises from about to about 90% of the composition.

Solid Rinse Additive

The solid rinse additive compositions of the present invention comprise a binder; an amount of the insoluble inorganic zinc salt, having an average particle size less than about 250 microns, to provide the composition with from about 1.0% to about preferably from about 2.0% to about 15% zinc; and optionally, up to about 70% of a low-foaming polyoxyalkylene nonionic surfactant. The binding agent of the solid rinse additive holds the dry components together in a single mass. The binding agent may comprise any material which is relatively high melting and which will maintain product integrity. Nonlimiting examples of suitable binding agents include materials such as nonionic surfactants, polyethylene glycols, anionic surfactants, film forming polymers, fatty acids, and mixtures thereof, wherein said binder does not melt below 40° C., as disclosed in U.S. Pat. No. 4,486,327, Murphy et al, issued Dec. 4, 1984, incorporated herein by reference. Preferred binders include alkali metal phosphates and fatty amides, preferably combinations thereof. Generally the binding material will comprise from about 30% to about 98% of the solid rinse aid composition.

Filler materials can also be present in the rinse aid composition of the present invention. These may include sucrose, sucrose esters, alkali metal chlorides and sulfates, etc., in amounts from about 0.001% to about 60%, preferably from about 5% to about 30% of the composition.

Methods of Making Rinse Aid Compositions

The rinse additive base products of the present invention can be prepared by any means commonly used to prepare such products.

The order of addition of the various ingredients of the formulation is not critical. For liquid rinse additive base compositions, most conveniently the formulations are made by forming a solution of the hydrotrope in water, and then adding the surfactant, and chelating agent (if present) in any desired order.

Any method of incorporating the insoluble inorganic zinc salt into the rinse additive composition which will result in maintenance of an insoluble inorganic zinc salt particle size of less than 250 microns may be used in the present invention.

If the rinse additive product is a solid material, such as the product JET DRY, available from Benckaiser, the insoluble inorganic zinc salt can simply be blended into a melt of the solid materials prior to incorporating the liquid components. Alternatively, the zinc salt may be added to the composition after all of the other components are combined. Because of the highly insoluble character of the zinc salt, there is little or no component interaction therewith in the composition. Hence exactly how and when the zinc salt is added is not critical. The insoluble inorganic zinc salt should be homogeneously dispersed in product, however, to assure equal glassware protection effectiveness with each release of product.

If the rinse additive product is a liquid material, the insoluble inorganic zinc salt can simply be mixed into the formulated liquid composition.

The insoluble inorganic zinc salt may be simply admixed, as is, into a finished powder or granular rinse additive product. (Such powder compositions will generally comprise the insoluble inorganic zinc salt together with optional nonionic surfactant and a filler or agglomerating material.) However, this method may result in segregation out of the zinc material during shipping and handling if the zinc material has a smaller particle size than the powder base. Alternatively, the insoluble inorganic zinc salt may be incorporated into a powder rinse additive composition via an agglomeration process wherein insoluble inorganic zinc salt particles which have an average size of less than 250 microns, are agglomerated with a soluble binding substance to result in particles which are about the same size as the base powder. These agglomerates of the insoluble inorganic zinc salt particles can then be simply mixed in with the preformed powder. More specifically, agglomeration of the zinc material may be accomplished by combining the material with a binder material and then hydrating the materials by spraying on water to form an agglomerate. A Schugi agglomerator/fluid bed, a spray dryer, a mix drum with a spray nozzle insert, or any other equipment suitable for agglomerating, may be used to form the agglomerates of insoluble inorganic zinc salt. Useful agglomerating materials include alkali metal phosphates and the organic agglomerating agents disclosed in U.S. Pat. No. 4,141,841, McDonald, issued Feb. 27, 1979, incorporated herein by reference.

The amount of water used to form the agglomerate will vary depending on the degree of hydration and the agglomerate size desired. The level of agglomerating material in the agglomerate will vary depending on the desired size of the agglomerate and the amount of insoluble inorganic zinc salt to be incorporated into the product. Typically, the agglomerate will comprise from about 1% to about 90% agglomerating material, from about 10% to about 30% water, and from about 1% to about 90% insoluble inorganic zinc material. A preferred execution has levels as follows: about 60% agglomerating material, about 22% water, and about 18% insoluble inorganic zinc salt.

Alternatively the insoluble inorganic zinc salt may be formed into a prill and mixed into the rinse additive base product. Any water-soluble polymer such as the binders disclosed above can be used to form the prill. Such a procedure would involve dispensing the zinc material into a molten polymer or polymer solution and then spray drying the mixture. Polyethylene glycol is an example of a water-soluble polymer which may be used to make such a prill. Generally, the polymer will comprise from about 10% to about 90% of the prill composition.

Method of Using

Automatic dishwashing (hereinafter ADW) machines employ a variety of wash cycles, or in the case of commercial practice, a variety of machine stages, which usually include a pre-rinse, one or more spray washings using an aqueous detergent solution, and one or more rinses to remove residual detergent and loosened soil. In the majority of modern machines, a rinse additive composition is added, via a separate dispenser, to the final rinse cycle or stage. Rinse additive compositions used in this fashion are typically liquid compositions but may be powder or granular.

For automatic dishwashing machines that are not equipped with a separate automatic rinse additive dispenser, a solid rinse additive may be used. Such a rinse additive generally is encased in a plastic basket which hangs from the top of the dishwasher. As water sprays the solid material, a small amount dissolves and is delivered to the dishware. This type of rinse additive dispenses material in both the wash and rinse and, hence, is not as efficient as the rinse additive products which are dispensed in the rinse cycle only.

As used herein, all percentages, parts, and ratios are by weight unless otherwise stated.

The following Examples illustrate the invention and facilitate its understanding.

EXAMPLE I

A solid rinse additive composition of the present invention is as follows:

| Component | Wt. % |
|---|---|
| Alkylbenzene ethoxylate | 10.0 |
| Polyethylene glycol | 22.0 |
| Phosphate ester | 4.0 |
| Sodium tripolyphosphate (STP) | 25.0 |
| Monoethanol amide ($C_{18}$) | 34.0 |
| Zinc carbonate (having a particle size less than 250 microns) | 5.0 |

The composition is prepared utilizing means commonly used to prepare such products. For example, the solid components except for the zinc carbonate and the STP are first melted. The liquid components are blended into the melt. The STP and zinc carbonate are blended in last. The mixture is put into molds of the desired shape and size and allowed to solidify. The formed solid material is then placed into a windowed plastic container and hung from an upper rack of the dishwasher. The composition is softened and dissolved to some degree during the wash and rinse cycle of an automatic dishwashing process. Such a composition may also be used in only the final rinse of the dishwashing process. Either way, use of this product in the automatic dishwashing process will provide protection against glassware corrosion caused in the wash cycle of the automatic dishwashing process.

Other compositions of the invention are obtained if the zinc carbonate is replaced in whole or in part with an alternative insoluble inorganic zinc salt selected from the group consisting of zinc silicate, zinc basic carbonate, zinc oxide, zinc hydroxide, zinc oxalate, zinc monophosphate, zinc pyrophosphate and mixtures thereof, having a particle size of less than about 250 microns.

EXAMPLE II

Liquid rinse additive compositions of the present invention are as follows:

| Component | Wt. % A | Wt. % B |
|---|---|---|
| Nonionic surfactant | 50.0[1] | 40.0[2] |
| Sodium cumene sulphonate | 4.0 | — |
| 1,2-propanediol sulphonate | — | 3.0 |
| Insoluble inorganic zinc salt | 2.0[3] | 10.0[4] |
| Water, dye, perfume | To 100% | To 100% |

[1]67.5% $C_{13}$ 35% primary aliphatic alcohol condensed with 5.75 moles of ethylene oxide and 2.85 moles propylene oxide per mole of alcohol.
[2]Pluronic L 61a polyoxyethylene polyoxypropylene condensates available from BASF Wyandotte Corporation.
[3]Zinc carbonate having an average particle size of less than 250 microns.
[4]Zinc oxide having an average particle size of less than 100 microns.

The composition is prepared utilizing means commonly used to prepare such products. For example, a solution is first formed of the sodium cumene sulphonate or the 1,2-propanediol in water, the nonionic surfactant and insoluble inorganic zinc salt are then added. If present, a dispersant to keep the zinc salt dispersed in the liquid medium may also be added.

This composition can be used in the rinse cycle of an automatic dishwashing process, to inhibit corrosion of glassware caused in the wash cycle of the automatic dishwashing process.

Other compositions of the present invention are obtained if the zinc carbonate or zinc oxide are replaced in whole or in part with alternative insoluble inorganic zinc salts selected from the group consisting of zinc silicate, zinc basic carbonate, zinc hydroxide, zinc oxalate, zinc monophosphate, zinc pyrophosphate, and mixtures thereof, having a particle size of less than about microns.

What is claimed is:

1. A liquid rinse additive composition, for use in an automatic dishwashing machine to inhibit glassware corrosion caused by washing with an automatic dishwashing detergent composition, comprising:

(a) from 0% to about 70% of a low-foaming polyoxyalkylene nonionic surfactant;

(b) an amount of an insoluble inorganic zinc compound, having an average particle size of less than about 250 microns, that will provide the composition with a level of zinc of from about 0.01% to about 10.0%; and (c) from about 25% to about 90% of a solvent system.

2. The composition of claim 1 comprising from about 10% to about 60% of the low-foaming polyoxyalkylene nonionic surfactant.

3. The composition of claim 2 wherein the solvent system comprises water together with from about 1% to about 25% by weight of the composition, of a hydrotrope selected from the group consisting of ethanol, isopropanol, 1,2-propanediol, a lower alkylbenzene sulphonate, or mixtures thereof.

4. The composition of claim 3 which additionally comprises from about 1.0% to about 10.0% of a dispersant for the insoluble inorganic zinc compound.

5. The composition of claim 4 wherein the dispersant is selected from the group consisting of polyacrylates, polyethylene glycol and mixtures thereof.

6. The composition of claim 5 wherein the insoluble inorganic zinc compound provides the composition with a level of zinc of from about 0.1% to about 5.0%.

7. The composition of claim 6 wherein the insoluble inorganic zinc compound is selected from the group consisting of zinc silicate, zinc carbonate, zinc basic carbonate, zinc oxide, zinc hydroxide, zinc monophosphate, zinc pyrophosphate, and mixtures thereof.

8. A solid rinse additive composition for use in an automatic dishwashing machine to inhibit glassware corrosion caused by washing with an automatic dishwashing detergent composition comprising:

(a) from 0% to about 70% of a low-foaming polyoxyalkylene nonionic surfactant;

(b) an amount of an insoluble inorganic zinc compound, having an average particle size of less than 250 microns, that will provide the composition with a level of zinc of from about 1.0% to about 70%; and (c) from about 30% to about 98% of a binder.

9. The composition of claim 8 comprising from about 10% to about 60% of the low-foaming polyoxyalkylene nonionic surfactant.

10. The composition of claim 9 wherein the binder is selected from the group consisting of alkali metal phosphates, fatty amides, and mixtures thereof.

11. The composition of claim 10 wherein the insoluble inorganic zinc compound provides the composition with a level of zinc of from about 2.0% to about 15%.

12. The composition of claim 11 wherein the insoluble inorganic zinc compound is selected from the group consisting of zinc silicate, zinc carbonate, zinc basic carbonate, zinc oxide, zinc hydroxide, zinc monophosphate, zinc pyrophosphate, and mixtures thereof.

13. A method of inhibiting corrosion of glassware caused by washing with an automatic dishwashing detergent composition, comprising adding to the rinse water an amount of an insoluble inorganic zinc compound which provides between 0.5 and 10 ppm solubilized zinc to the rinse water.

14. A method for inhibiting corrosion of glassware in the wash cycle of an automatic dishwashing machine comprising contacting the glass in the rinse cycle with rinse water comprising the composition of claim 7.

15. A method for inhibiting corrosion of glassware in the wash cycle of an automatic dishwashing machine comprising contacting the glass in the rinse cycle with rinse water comprising the composition of claim 12.

* * * * *